US005495975A

United States Patent [19]

Jairam et al.

[11] Patent Number: 5,495,975

[45] Date of Patent: Mar. 5, 1996

[54] STAPLER WITH SHEATH CONTROL MECHANISM

[75] Inventors: Sarwan A. Jairam, Richmond Hill; Frank H. F. Lin, College Point, both of N.Y.

[73] Assignee: Acco USA, Inc., Wheeling, Ill.

[21] Appl. No.: 353,875

[22] Filed: Dec. 12, 1994

[51] Int. Cl.[6] ..... B25C 5/00; B27F 7/17

[52] U.S. Cl. ..... 227/123; 227/109; 227/131

[58] Field of Search ..... 227/109, 120, 227/123, 131

[56] References Cited

U.S. PATENT DOCUMENTS 3,840,165 10/1974 Howard ..... 227/123 X 4,139,137 2/1979 Gupta ..... 227/123

4,436,236 3/1984 Jobe ..... 227/123

4,467,952 8/1984 Morrell, Jr. ..... 227/123

5,350,103 9/1994 Monacelli ..... 227/123 X

*Primary Examiner*—Richard K. Seidel

*Assistant Examiner*—Jay A. Stelacone

*Attorney, Agent, or Firm*—Pennie & Edmonds

[57] ABSTRACT

A stapler in which the sheath is held in fixed operable position by a pin during operation with the sheath configured to assure such holding. Sheath opening is accomplished by action of a separate release lever which releases with ease the sheath from the pin.

10 Claims, 4 Drawing Sheets

STAPLER WITH SHEATH CONTROL MECHANISM

BACKGROUND OF THE INVENTION

While numerous satisfactory arrangements for clearing jams in staplers have been proposed (U.S. Pat. Nos. 5,121,868 and 4,913,332), the present invention provides ready and open access to the jammed area.

SUMMARY OF THE INVENTION

Broadly, the present invention is a stapler having a head and sheath with the sheath pivotal about the head and held during operation by a releasable latch positioned with respect to the head to form a staple drive channel. Also pivotal on the head in close association with the sheath is a release lever which functions to facilitate operation of the latch to release the sheath for clearing jammed staples.

DESCRIPTION OF THE PREFERRED EMBODIMENT

Figure 1:
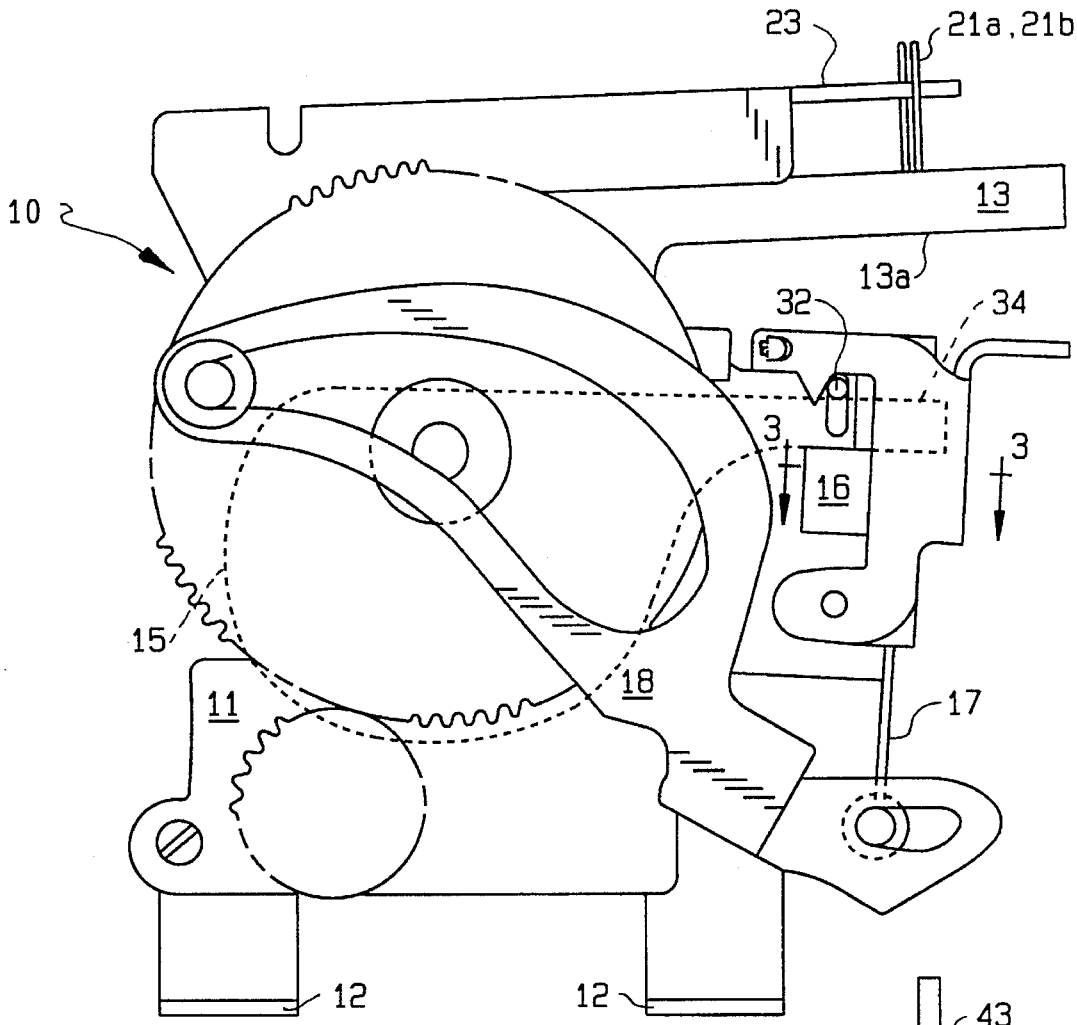
FIG. 1 is a side elevational view of the stapler of the present invention with the staple cartridge in dashed lines.

Referring to the figures, stapler 10 includes frame 11, feet 12, upper frame 13 carrying anvil 13*a*, head 16, staple former and driver unit 17 and driver mechanism 18. Also shown are clinching wings 21*a*, 21*b* and wing driver 23. Head 16, which moves upwardly (not downwardly as is more common) during the staple driving portion of its cylindrical movement, has upper surface 16*s* (FIG. 3) upon which staple blank cartridge 15 is positioned during operation. Cartridge 15 engages pin axle 32 during operation to prevent axle 32 movement.

Figure 2:
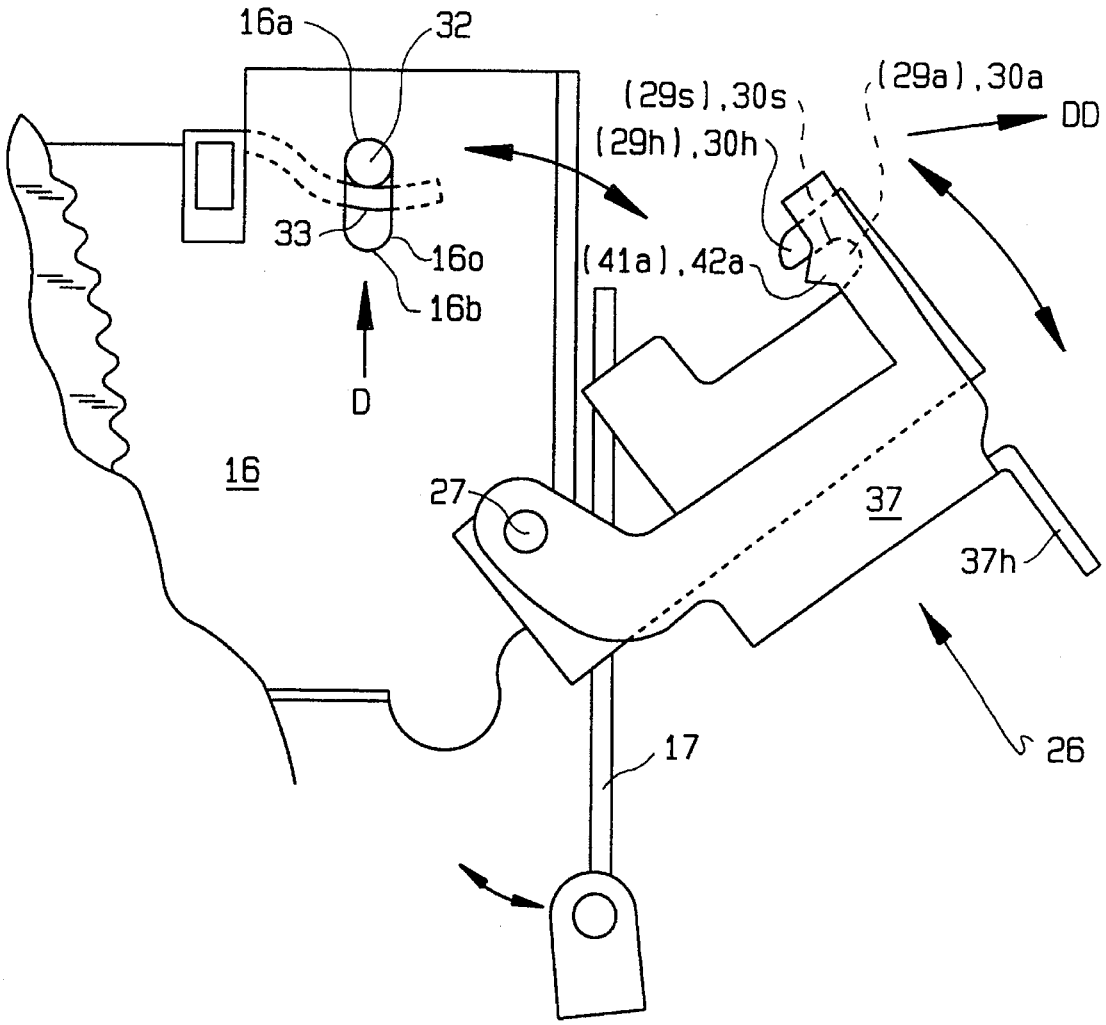
FIG. 2 is a side partial elevational view of the stapler head and pivotal sheath in its open position.
Figure 3:
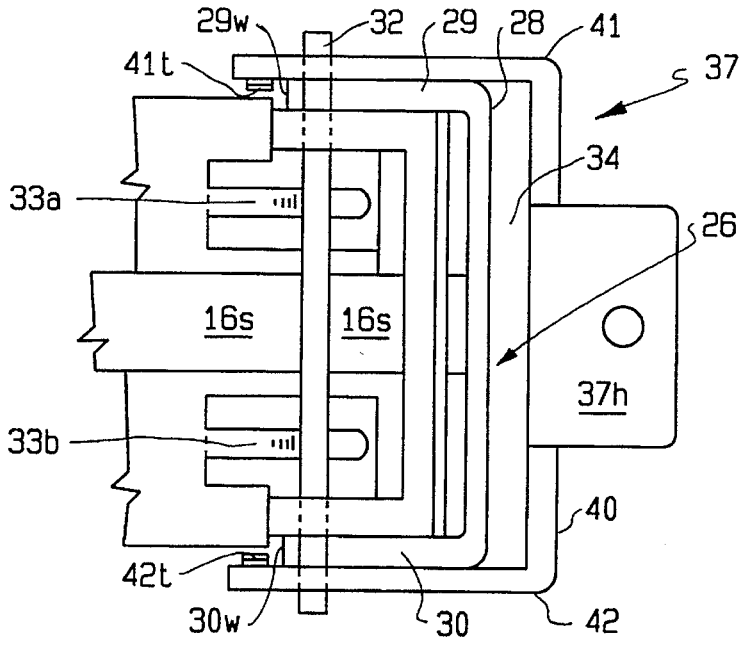
FIG. 3 is a partial sectional view of the stapler head, sheath and sheath release lever taken along line 3—3 of FIG. 1.
Figure 4:
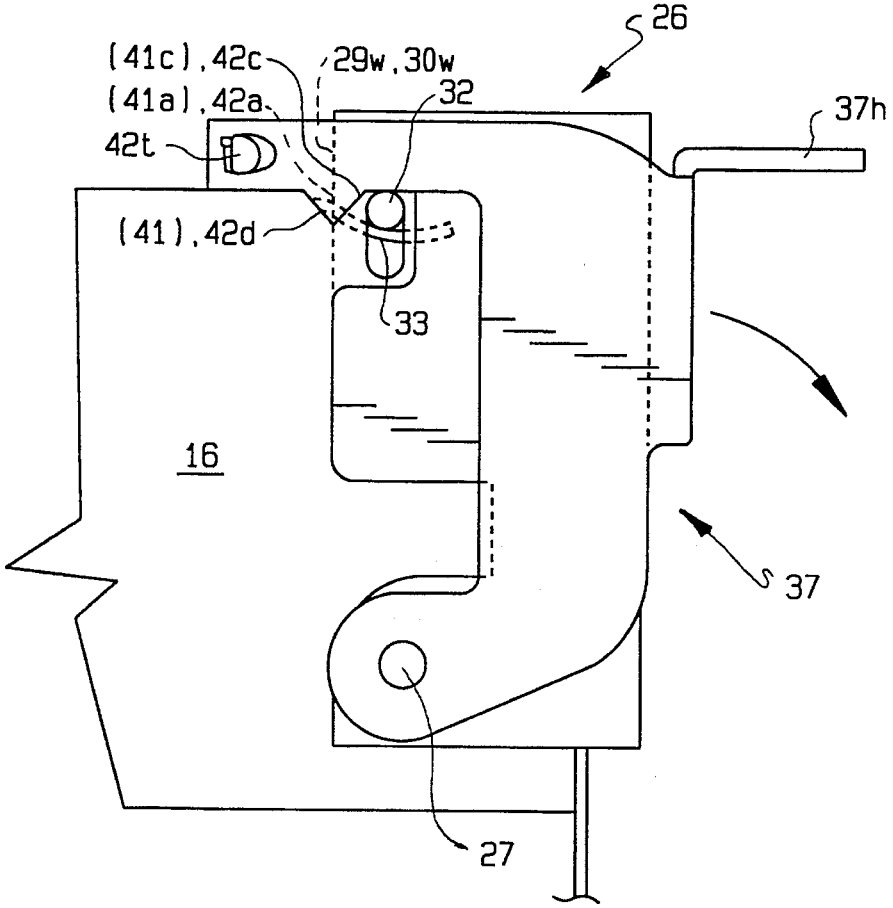
FIG. 4 is a partial elevational view of the head, sheath and sheath release lever in operating position.

Turning to FIGS. 2 and 3, pivotal sheath 26 is shown pivotal about axis 27 in head 16. Sheath 26 includes front portion 28 and side portions 29, 30. Side portions 29, 30 have end walls 29*w*, 30*w*. Each side portion 29, 30 has a hook 29*h*, 30*h* forming openings 29*a*, 30*a* configured to engage and be held in operating position by pin axle 32 urged upwardly by spring 33 in a direction D in FIG. 2. Openings 29*a*, 30*a* have front slope surfaces 29*s*, 30*s* which engage pin axle 32 to actuate pin axle 32. Movement of pin axle 32 is limited by upper and lower surfaces 16*a*, 16*b* of each oval slot 16*o*. During normal operating conditions, sheath 26 is held spaced from head 16 to form staple transport channel 34 (FIG. 3).

When a staple jam occurs, sheath release lever 37 nested outside the sheath 26 is pivoted about axis 27 by grasping handle 37*h*. Lever 37 includes front plate 40 and two (2) side plates 41, 42. Side plates 41, 42 include internal tabs 41*t*, 42*t* which engage end walls 29*w*, 30*w* of sheath 26 to assure its rotation with lever 37. Upon initial movement of lever 37, pin 32 is caused to be cammed downwardly by cam projections 41*a*, 42*a* overcoming spring 33 so that sheath 26 is released. Sheath 26 is also at that time free to rotate about axis 27 as urged by lever tabs 41*t*, 42*t*.

Figure 7:
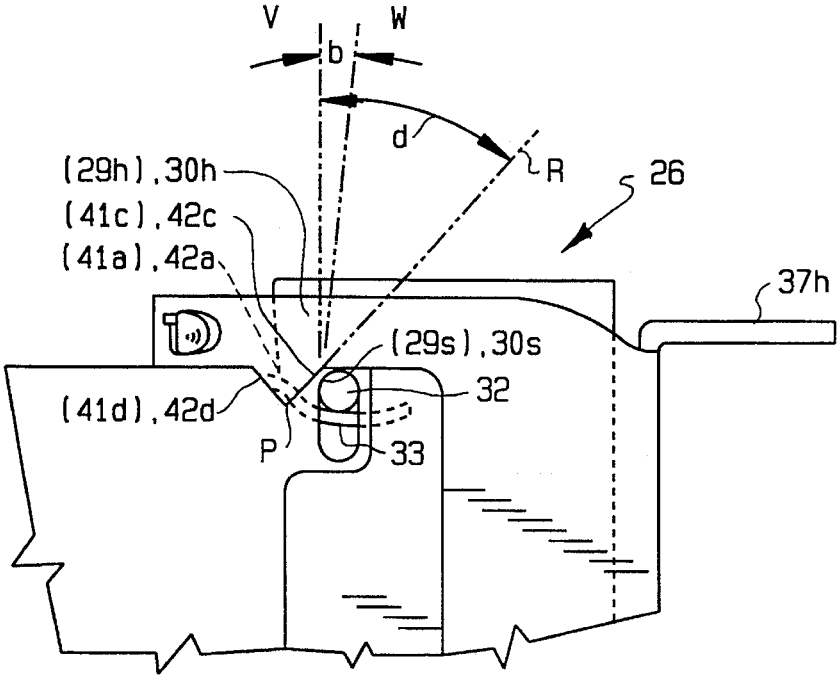
FIG. 7 is an enlarged partial elevational view of a portion of FIG. 4.

The cam projections 41*a*, 42*a* of lever 37 have in turn front cam surfaces 41*d*, 42*d* and rear cam surfaces 41*c*, 42*c*, which are angled to make pin axle 32 depress with ease when lever 37 is pulled right in direction DD to open or reversed to close. The shallow angles of surfaces 41*c*, 42*c* and 41*d*, 42*d* ease in the depression of pin axle 32 in either direction. In contrast, the cam front slopes 29*s*, 30*s* of sheath 26 are steeper than surfaces 41*c*, 42*c* as shown in FIG. 7. Pulling on sheath 26 directly requires a larger force to overcome spring 33 and thereby depress pin axle 32. Vertical reference line V is tangent to cam slope 30*s* of hook 30*h* (shown in dashed lines) at point P where axle 32 would first engage sheath 26 if it were pulled to effect its release. Lines V and W form angle b. Line R is an extension of cam surface 42*c* on lever 37. Lines V and R form angle d. Since angle b is smaller than angle d, surface 30*s* is steeper than surface 42*c*. Pulling sheath 26 to an open or release position would take a larger force than the force that is applied, in the practice of this invention, to lever 37 to cam down pin axle 32 for release of sheath 26. During normal operation sheath 26 is held in place by pin axle 32 and cartridge 15 despite normal stapling forces applied to it. The steepness of cam front slopes 29*s*, 30*s* assists in holding sheath 26 during stapler operation. Once released, sheath 26 is further swung to its completely open position (FIG. 2) for channel inspection and a clearing of staples jammed therein.

Figure 6:
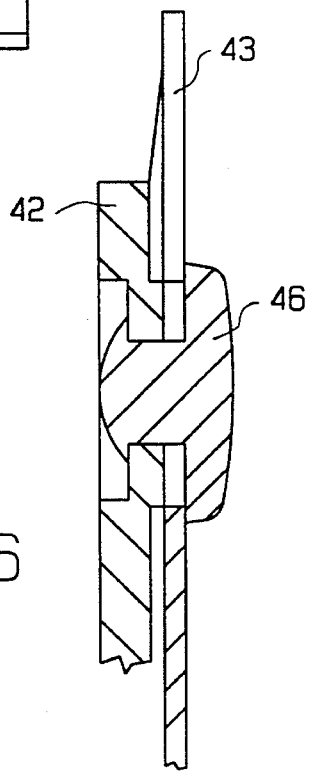
FIG. 6 is a sectional view taken along line 6—6 of FIG. 5.
Figure 5:
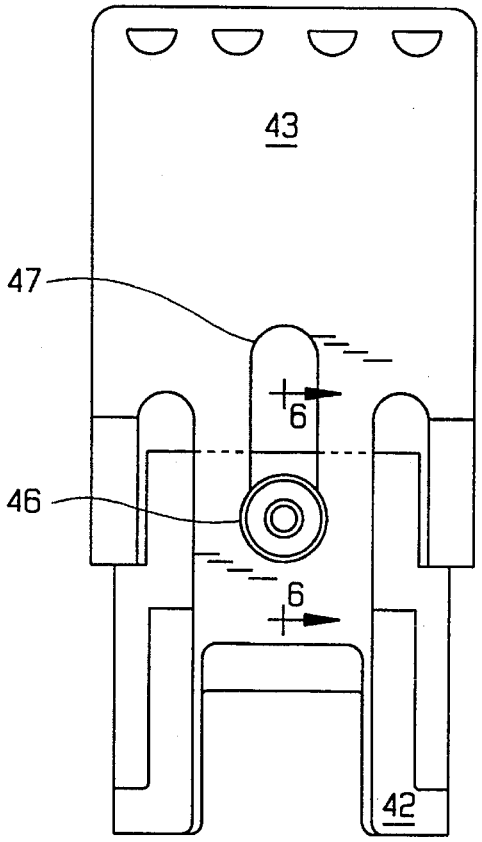
FIG. 5 is a front elevational view of the former and driver.

As sheath 16 is so opened wide for clearing, the former and driver unit 17 which include former 42 and driver 43 remain connected together by rivet 46 attached to former 42. Rivet 46 rides in driver slot 47 (see FIGS. 5 and 6) to prevent separation of the former and driver unit 17. Rivet 46 holds former 42 and driver 43 together as a unit.

I claim:

1. In a stapler having a head and a sheath positioned adjacent the head to form a staple driving transport channel and having adjacent said channel a removable staple blank cartridge to feed staples to said channel, the improvement comprising (a) pivot means on the head and sheath for pivotal movement of the sheath with respect to the head;

(b) first latch means on the sheath;

(c) second latch means on the head for engaging the first latch means, said second latch means in turn comprising an opening in the head having a top surface and a bottom surface, a latch pin positioned in the opening and a spring urging such pin toward the top surface.

2. In a stapler having a head and a sheath positioned adjacent the head to form a staple driving transport channel and having adjacent said channel a removable staple blank cartridge to feed staples to said channel, the improvement comprising (a) pivot means on the head and sheath for pivotal movement of the sheath with respect to the head;

(b) first latch means on the sheath, said first latch means including hook means and a pin in which said hook means engages the pin at a steep angle such that a first force is required to be applied to the sheath to release the sheath;

(c) second latch means on the head for engaging the first latch means;

(d) a release lever also pivotally mounted on the head and surrounding the sheath which lever when rotated, engages the second latch means to release the sheath, said release lever includes projection means which engages said pin at a shallow angle such that when a second force smaller than the first force is applied to the lever, said pin is depressed to release the sheath.

3. The stapler of claim 2 in which said pin is held in fixed position by the cartridge when the cartridge is installed and permits movement of the pin when the cartridge is removed.

4. In a stapler having a head and a sheath positioned adjacent the head to form a staple driving transport channel and having adjacent said channel a removable staple blank cartridge to feed staples to said channel, the improvement comprising (a) pivot means on the head and sheath for pivotal movement of the sheath with respect to the head;

(b) first latch means on the sheath;

(c) second latch means on the head for engaging the first latch means; said first and second latch means holding the sheath in operating position relatively to the head and capable of disengaging when a first force is applied to the sheath;

(d) a release lever also pivotally mounted on the head and surrounding the sheath; which lever, when a force different form the first force is applied, causes disengagement of said first and second latch means to release the sheath.

5. The stapler of claim 4 in which the lever engages the sheath after release of the sheath to rotate the sheath.

6. The stapler of claim 4 in which the sheath has a front portion and two side portions at right angles to the front portion and the release lever has a front portion and two side portions at right angles to the front portion.

7. The stapler of claim 4 in which the second latch means comprises an opening in the head having a top surface and a bottom surface, a latch pin positioned in the opening and a spring urging such pin toward the top surface.

8. The stapler of claim 4 in which the first latch means includes hook means and a pin and in which said hook means engages the pin at a steep angle such that a first force is required to be applied to the sheath to release the sheath and in which the release lever includes projection means which engages the pin at a shallow angle such that when a second force smaller than the first force is applied to the lever, the pin is depressed to release the sheath.

9. The stapler of claim 8 in which the release lever includes a handle for applying the second force.

10. The stapler of claim 8 in which said pin is held in fixed position by the cartridge when the cartridge is installed and permits movement of the pin when the cartridge is removed.

* * * * *